US007874961B2

(12) United States Patent
McKee et al.

(10) Patent No.: US 7,874,961 B2
(45) Date of Patent: Jan. 25, 2011

(54) MACHINES AND METHODS FOR COMBINED AND ISOLATED UPPER AND LOWER BODY WORKOUTS

(75) Inventors: Todd McKee, O'Fallon, MO (US); Robert Starr, St. Charles, MO (US)

(73) Assignee: True Fitness Technology, Inc., O'Fallon, MO (US)

( * ) Notice: Subject to any disclaimer, the term of this patent is extended or adjusted under 35 U.S.C. 154(b) by 0 days.

(21) Appl. No.: 12/367,659

(22) Filed: Feb. 9, 2009

(65) Prior Publication Data

US 2009/0143198 A1 Jun. 4, 2009

Related U.S. Application Data

(62) Division of application No. 11/856,630, filed on Sep. 17, 2007.

(60) Provisional application No. 60/825,797, filed on Sep. 15, 2006.

(51) Int. Cl.
*A63B 22/04* (2006.01)

(52) U.S. Cl. ..... 482/52; 482/9; 482/62

(58) Field of Classification Search ..... 482/3, 482/4, 9, 51–52, 54, 57, 62, 70–71, 117–118, 482/138

See application file for complete search history.

(56) References Cited

U.S. PATENT DOCUMENTS 2,198,942 A * 4/1940 Leggitt ..... 280/87.01
3,309,084 A * 3/1967 Simmons ..... 482/62
3,345,067 A * 10/1967 Smith ..... 482/123
5,013,034 A * 5/1991 March et al. ..... 482/115
5,016,870 A * 5/1991 Bulloch et al. ..... 482/62
5,108,093 A * 4/1992 Watterson ..... 482/70
5,282,776 A * 2/1994 Dalebout ..... 482/118
5,284,461 A * 2/1994 Wilkinson et al. ..... 482/53
5,372,560 A * 12/1994 Chang ..... 482/54
5,441,467 A * 8/1995 Stevens ..... 482/54
5,460,586 A * 10/1995 Wilkinson et al. ..... 482/54
5,507,708 A * 4/1996 Ma ..... 482/52
5,803,874 A * 9/1998 Wilkinson ..... 482/54
5,830,107 A * 11/1998 Brigliadoro ..... 482/1
5,902,216 A * 5/1999 Lee ..... 482/57
6,511,404 B2 * 1/2003 Tu ..... 482/57
6,648,800 B2 * 11/2003 Stearns et al. ..... 482/52
6,689,019 B2 * 2/2004 Ohrt et al. ..... 482/52
6,719,667 B2 * 4/2004 Wong et al. ..... 482/54
6,758,790 B1 * 7/2004 Ellis ..... 482/52
6,835,166 B1 * 12/2004 Stearns et al. ..... 482/52
6,878,101 B2 * 4/2005 Colley ..... 482/54
6,994,656 B2 * 2/2006 Liao et al. ..... 482/52
7,025,710 B2 * 4/2006 Corbalis et al. ..... 482/52
7,097,591 B2 * 8/2006 Moon ..... 482/52
7,182,714 B2 * 2/2007 Moon ..... 482/52

(Continued)

*Primary Examiner*—Rinaldi I Rada
*Assistant Examiner*—Andrew M Tecco
(74) *Attorney, Agent, or Firm*—Lewis, Rice & Fingersh, L.C.

(57) ABSTRACT

An elliptical exercise machine allowing a user to move between a first position (standing on a stationary platform and using the machine's exercise arms), a second position (using the machine's footskates and holding a stationary handlebar), and a third position (using the machine's footskates and exercise arms), or any variation thereon. The machine may include a computer that directs the user's movements between those positions and others.

6 Claims, 7 Drawing Sheets

U.S. PATENT DOCUMENTS

| | | | | |
|---|---|---|---|---|
| 7,201,707 | B1 * | 4/2007 | Moon | 482/52 |
| 7,207,925 | B2 * | 4/2007 | Moon | 482/52 |
| 2002/0107112 | A1 * | 8/2002 | Lim | 482/51 |
| 2003/0013586 | A1 * | 1/2003 | Rothschild | 482/117 |
| 2004/0018917 | A1 * | 1/2004 | Corbalis et al. | 482/54 |
| 2004/0063549 | A1 * | 4/2004 | Kuo | 482/54 |
| 2004/0192514 | A1 * | 9/2004 | Piaget et al. | 482/54 |
| 2005/0233285 | A1 * | 10/2005 | Miyamaru et al. | 434/61 |
| 2005/0250621 | A1 * | 11/2005 | Corbalis et al. | 482/52 |
| 2005/0277516 | A1 * | 12/2005 | Girard et al. | 482/52 |
| 2006/0009331 | A1 * | 1/2006 | Cheng | 482/52 |
| 2006/0035755 | A1 * | 2/2006 | Dalebout et al. | 482/52 |
| 2006/0052220 | A1 * | 3/2006 | Jackson et al. | 482/52 |
| 2006/0079381 | A1 * | 4/2006 | Cornejo et al. | 482/52 |
| 2006/0199703 | A1 * | 9/2006 | Shifferaw | 482/52 |
| 2007/0117684 | A1 * | 5/2007 | Liao et al. | 482/52 |
| 2007/0117686 | A1 * | 5/2007 | Liao et al. | 482/52 |
| 2007/0161464 | A1 * | 7/2007 | Chiles et al. | 482/52 |
| 2007/0225126 | A1 * | 9/2007 | Yoo | 482/54 |

* cited by examiner

MACHINES AND METHODS FOR COMBINED AND ISOLATED UPPER AND LOWER BODY WORKOUTS

CROSS REFERENCE TO RELATED APPLICATION(S)

This application is a divisional of U.S. patent application Ser. No. 11/856,630, filed Sep. 17, 2007, which in turn claims benefit of U.S. Provisional Patent Application Ser. No. 60/825,797 filed Sep. 15, 2006. The entire disclosure of both documents is herein incorporated by reference.

BACKGROUND

1. Field of the Invention

This disclosure relates to the field of cardiovascular exercise machines. In particular, to elliptical exercise machines which permit and direct focused exercise by the upper and lower body both in combination and independently of each other.

2. Description of the Related Art

The benefits of regular aerobic exercise on individuals of any age are well documented in fitness science. Aerobic exercise can dramatically improve cardiac stamina and function, as well as lead to weight loss, increased metabolism, and other benefits. At the same time, aerobic exercise has often been linked to damaging effects, particularly to joints or similar structures, where the impact from many aerobic exercise activities can cause injury. Therefore, those involved in the exercise industry are continuously seeking ways to provide users with exercises that have all the benefits of aerobic exercise, without the damaging side effects.

Most low-impact aerobic exercises have traditionally been difficult to perform. Many low-impact aerobic exercises (such as those performed in water) traditionally require performance either outside or at a gym. Cold weather, other undesirable conditions, and cost can make these types of aerobic exercise unobtainable at some times and to some people. In order to allow people to perform aerobic exercises without having to go outside or to gyms or the like, fitness machines have been developed to allow a user to perform aerobic exercises in a small area of their home.

Many of these machines, however, are either too physically demanding on the user or too complicated to use. In either case, the machine falls into disuse. Recently, a class of machines which are referred to as "elliptical machines" or "elliptical cross-trainers" have become very popular due to their ease of use and their provision of relatively low-impact aerobic exercise.

Generally on these types of machines, a user performs a motion using their legs that forces their feet to move in a generally elliptical motion about each other. This motion is designed to simulate the motion of the feet when jogging or climbing, but the rotational motion is "low-impact" compared to jogging or climbing where the feet regularly impact a surface. In an elliptical machine, a user uses a fairly natural motion to instead move their feet through the smooth exercise pattern dictated by the machine. This motion has historically been complemented by the user moving his or her arms in a reciprocating motion while pulling or pushing various arms on the machine whose motion is connected to the motion of the feet, and vice-versa.

An increasingly common component of aerobic exercise equipment is a computer that allows the user to electronically control aspects of the user's experience with the machine, including speed, resistance, and length of workout. Moreover, many computers provide the user with a selection of preprogrammed or directed workouts. These directed workouts permit the user to engage the machine in a set schedule of different speeds and amounts of resistance over a set amount of time. Users benefit from these directed workouts due to their variety, which decreases the likelihood of user boredom and disuse of the machine as compared to a user interacting with the machine in the same undirected way each time. Their set nature can coerce users to engage in a higher level of activity for a longer period of time than they might if left to their own motivation.

Currently, elliptical machines and the directed workouts they provide are problematically limited to combined arm and leg movements that are monotonously and continuously repeated for the duration of each workout. Users are confined to one continuously repeated, full-body motion, in which the user's arm motions are necessarily in synchrony with his or her foot motions due to the mechanical linkage between the machine's arms and foot pedals. Users may only alter the speed and resistance at which they perform the single motion.

Many users of current elliptical machines become bored of the repetitive motion the machines mandate. User boredom is a singular challenge in the fitness industry, as illustrated by the ubiquitous television screens, music options, and magazines present in current gyms and relied upon by users to maintain their interest throughout their workout. Current elliptical machines exacerbate this issue of user boredom, by forcing users to repeat the same motion and stand in the same stance throughout every workout. It is desirable for users to be able to very their stance and movement during the workout, simply to prevent boredom.

Secondly, users who wish to tone or target particular parts of their bodies are stymied by current elliptical machines. Some fitness machine users with goals more specific than general cardiovascular activity are not satisfied with current elliptical machines, which by their very structure require full body movement. For example, users who are substantially weaker in their upper body than their lower body cannot improve this disparity by using current elliptical machines, because the machine's movement by design is driven by the user's arms and legs in cooperation. Users seeking a focused workout are forced to turn to machines other than elliptical machines, such as weight machines. These users are unable to reap the benefit of portability and home use that elliptical machines provide, as they must have access to equipment in addition to a traditional elliptical machine to achieve their fitness goals. It is therefore desirable that an elliptical machine provide the ability to focus workouts on that machine to the upper or lower body, in isolation.

Directed workouts on current elliptical machines have the same short comings. As the users themselves cannot achieve workout or stance variety on current elliptical machines, nor a workout focused on a particular part of the body, clearly the machine's directed workouts cannot accommodate such user preferences. It is desirable that a directed elliptical machine workout provide for variety of motions and stances throughout the workout, and for targeted exercise by the upper and/or lower body independently.

These limitations are all sourced in the user's lack of options for foot placement on current elliptical machines. Users may not comfortably operate the machine's arms while standing on the floor, given the height of the handgrips and the bulk of the machine. Therefore, users must rely on current elliptical machines' sole location for users' feet: the footskates, which are the mobile portion of an elliptical machine that will traverse the same ellipse as the user's feet. These footskates are fixedly and mechanically linked to the machine's arms, such that the footskates and the arms must move in synchrony. While many current machines provide a stationary handhold in addition to the handgrips on the mobile arms, which users may grasp if they wish to exercise their legs in isolation, no current machine permits users to exercise their arms in isolation. The forced use of the footskates, in combination with the mechanical linkage of the footskates and the machine's arms, necessitates exercising one's lower body along with one's upper body. Moreover, users are confined to a single body position—standing on the footskates—and may not alter stances to target different muscle groups and provide variety over the course of the workout or among workout sessions.

The presence of only one footskate also limits directed workouts on current elliptical machines to synchronous upper and lower body exercise. Elliptical machine users who have come to rely on the variety, set nature, and focused approach of directed workouts are currently lacking a directed workout on a single machine that targets upper or lower body exercise independently, and one that can serve to break the monotony of repeating the same full-body motion for the entire workout period and across different workouts.

SUMMARY

The following is a summary of the invention in order to provide a basic understanding of some aspects of the invention. This summary is not intended to identify key or critical elements of the invention or to delineate the scope of the invention. The sole purpose of this section is to present some concepts of the invention in a simplified form as a prelude to the more detailed description that is presented later.

Because of these and other problems in the art, described herein, among other things, are elliptical exercise machines where the arm and leg movements may be performed in synchrony or independently. This is generally referred to as allowing for "combined and isolated upper and lower body workouts" by the elliptical machine. Further, the machines described herein are generally intended to allow for combined or isolated workouts as the user desires or as a computer-provided directed workout indicates.

Described herein, among other things, is a method of using a cardiovascular exercise machine, comprising supplying a cardiovascular exercise machine to a user, wherein the machine comprises a frame, a rail movably connected to the frame and also connected to a crankshaft such that the rail traverses a path in conjunction with the crankshaft's rotation relative to the frame, a pendulum arm connected to the frame that reciprocates as the crankshaft rotates, a footskate capable of reciprocating movement on the rail, a stationary loadbearing platform functionally separated from the crankshaft but rigidly connected to the frame at an operative distance and angle from the pendulum arm and sized and shaped to support a user, and a handlebar fixedly connected to the frame at an operative distance and angle from the footskate and separated from the crankshaft; providing a first position wherein the user stands on the platform and moves the exercise arm; providing a second position wherein the user moves the footskate and grasps the handlebar; providing a third position wherein the user moves the footskate and the exercise arm; and having the user move among the first position, the second position, and the third position.

In an embodiment, the step of having is performed within a single workout session. In a further or alternate embodiment, the method further comprises a step of adjusting the platform, and/or a step of adjusting the handlebar. The first position may be one of a plurality of first positions, wherein each of the first positions utilizes a distinguishable platform from each other of the first positions. In an embodiment, the moving the exercise arm or the moving the footskate is affected by a resistance device.

In an embodiment of the method, the machine further comprises a computer, wherein the computer directs the steps of providing and having. In a further embodiment, the method further comprises a step of selecting a computer-directed workout, wherein the workout directs the user's movement among the first position, the second position, and the third position.

Also disclosed herein, among other things, is an elliptical exercise machine comprising a frame; a rail movably connected to the frame and also connected to a crankshaft such that the rail traverses a path in conjunction with the crankshaft's rotation relative to the frame; a pendulum arm connected to the frame that reciprocates as the crankshaft rotates; a footskate capable of reciprocating movement on the rail; a stationary loadbearing platform functionally separated from the crankshaft but rigidly connected to the frame at an operative distance and angle from the pendulum arm and sized and shaped to support a user; and a handlebar fixedly connected to the frame at an operative distance and angle from the footskate and separated from the crankshaft.

In an embodiment of the machine, the platform's spatial attributes are adjustable. In a further or alternative embodiment, the handlebar's spatial attributes are adjustable.

The machine may further comprise a computer capable of directing a user's use of the footskate, the platform, the pendulum arm, and the handlebar. Alternatively or additionally, the machine may further comprise a device for adjusting the size of the stride, including but not limited to: an adjustment arm, the adjustment arm connected to the frame at a second rotational axis, spaced from the first rotational axis; the adjustment arm being operationally attached to the footskate via an interface located toward the distal end of the adjustment arm so that reciprocation of the adjustment arm through a second arc segment is translated into the reciprocating movement of the footskate; a coupler connecting the adjustment arm to the pendulum arm so that when the pendulum arm reciprocates about the first rotational axis, the adjustment arm is forced to reciprocate about the second rotational axis; the coupler being spaced a first distance from the first axis and a second distance from the second axis; wherein, at least one of the first distance and the second distance is variable, such that the stride of the machine may be altered while the machine is in use to permit stride adjustment for comfort or to generate a particular type of exercise.

In an embodiment, at least one of the crankshafts is attached to a flywheel or a resistance device. In a further embodiment, the flywheel or the resistance device is controlled by a computer.

In an embodiment, the platform is one of a plurality of the platforms.

DESCRIPTION OF PREFERRED EMBODIMENT(S)

Figure 1:
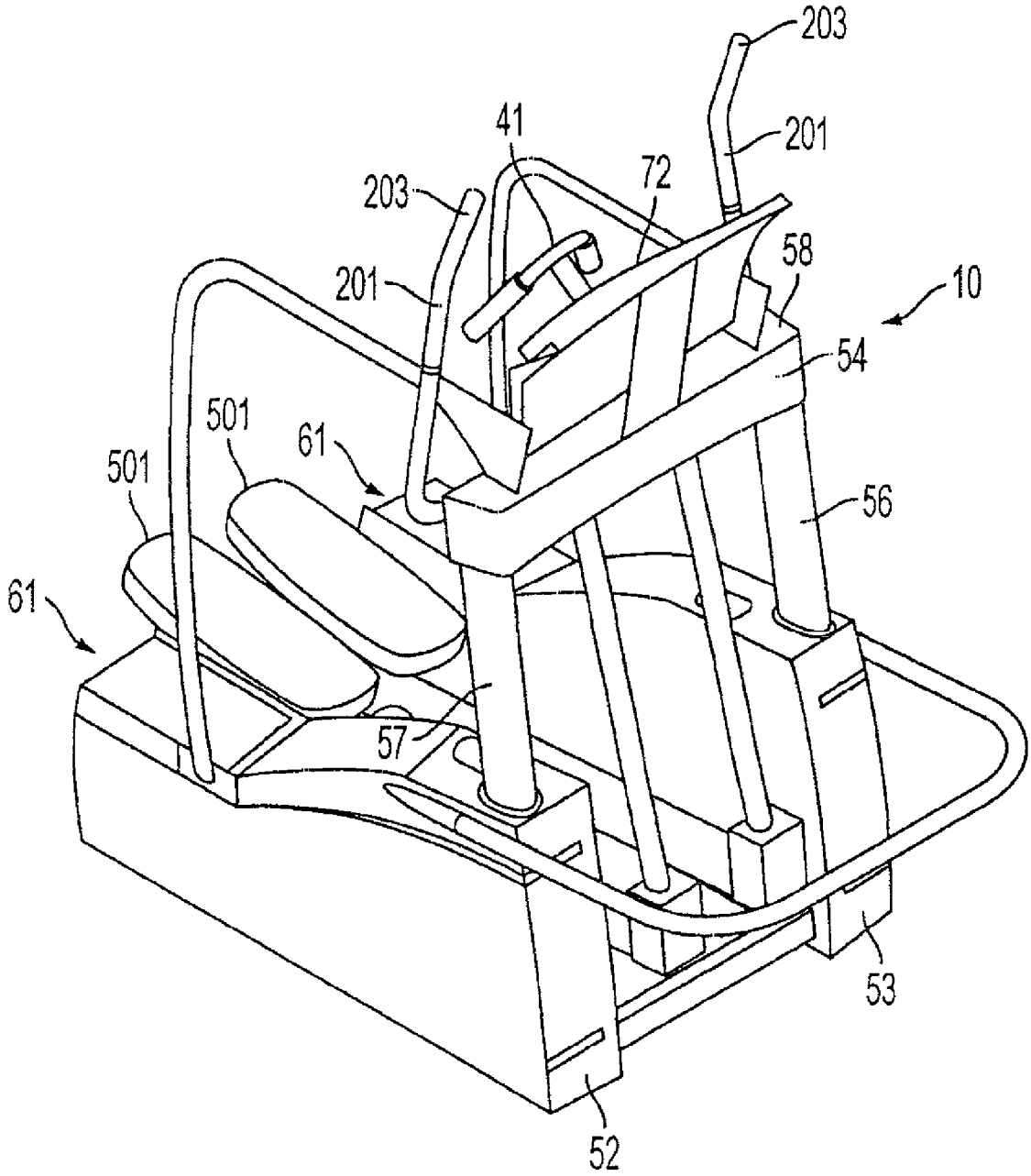
FIG. 1 shows a front angular perspective view of an embodiment of an exercise machine with a system for combined and isolated upper and lower body workouts with the frame cover in place.

Although the machines, devices, and methods described below are discussed primarily in terms of their use with a particular layout of an elliptical exercise motion machine utilizing two rotational crankshafts and handgrip pendulum arms, one of ordinary skill in the art would understand that the principles, methods, and machines discussed herein could be adapted, without undue experimentation, to be useable on an elliptical motion machine which generates its elliptical motion through the use of other systems. It may also be used on any aerobic machine that encourages coordinated upper and lower body movements through mechanical linkage.

The embodiment disclosed herein primarily relates to elliptical exercise machines where a reciprocating footskate which traverses a fixed linear portion of a main drive link is replaced by a system where such a reciprocating footskate is supplemented by a stationary loadbearing platform adjacent to the reciprocating footskate, which permits the user to either stand on the platform and not move the feet in the traditional elliptical pattern, or on the reciprocating footskate while operating the pendulum arms; and which permits the user to step off the footskate onto the platform and step on again during the course of the workout; and where a fixed handlebar permits the user to use the reciprocating footskate with arms stationary or while moving the pendulum arms. In a further embodiment, a computer provides direction as to whether the user should stand on the footskate or platform, and grasp the handlebar or pendulum arms.

The machine provides for independent performance due to the presence of, firstly, a stationary, lateral foot platform from which the upper body movement may be performed while the feet remain fixed; and secondly, a stationary handlebar which the user may grasp to fix the arms while the lower body movement is performed.

For the purposes of this disclosure, the terms "horizontal" and "vertical" will be used when referring to the dimensions of the ellipse drawn by the user's feet. One of ordinary skill in the art will understand that depending on the arrangement of the parts and how the machine is used, the ellipse traversed by the user's feet may be at an angle to the vertical and horizontal. That is, a line connecting the two axes of the ellipse may not be completely horizontal or completely vertical, or in some cases it may be. For the purposes of this disclosure, when the horizontal dimension of the ellipse is referred to, it is referring to the longest dimension of the ellipse (line through both axes), and the vertical dimension is the shortest dimension of the ellipse (line evenly spaced between the two axes). These dimensions are not used to strictly mean horizontal and vertical relative to the earth. Further, while most of this discussion will refer to the operation of a single side of an exercise machine, one of ordinary skill in the art would understand that the other side will operate in a similar manner.

Further, while the system discusses "elliptical motion," it should be recognized that that term, as is used in the art of exercise machines, does not require the foot of the user to traverse a true ellipse, but that the foot of the user traverses a generally elliptical or similar rotational shape. The shape will generally not be circular, but may be circular, oval, elliptical, in the shape of a racetrack, kidney-shaped, or in any other shape having a relatively smoothly curving perimeter with a horizontal and vertical component of movement.

FIG. 1 depicts an embodiment of an elliptical motion exercise machine (10) including a system for combining and isolating upper and lower body workouts. The exercise machine (10) is comprised of a frame (50) of generally rigid construction which will sit stably on a surface to provide for the general shape of the machine (10) as shown in FIG. 1. The frame (50) is generally constructed of strong rigid materials such as, but is not limited to, steel, aluminum, plastic, or any combination of the above. The frame (50) may be of any shape, but will generally be designed to provide a place to attach the remaining components and to provide a structure which can resist damage or breakage from repeated use by the individual exercising thereon. The frame (50) will also generally be designed so as to stably support a user utilizing the exercise machine (10) and prevent the machine from having undue sway or other undesirable motion while the user is exercising. In the depicted embodiment, frame (50) includes three major substructures: left and right main supports (52) and (53), crossbeams (54), and vertical riser beams (56) and (57).

The main supports (52) and (53) will generally rest on the surface upon which the exercise machine (10) is placed. This surface will generally be flat. One of ordinary skill in the art would understand that the surface need not be flat as the position of the machine is only important relative to the user but, for clarity, this disclosure will presume that the machine is placed on a generally flat surface. The main supports (52) and (53) are then held at a position spaced apart from each other by the crossbeams (54). There may be any number of crossbeams (54) and the depicted number of four is by no means required. The vertical riser beams (56) and (57) extend generally away from the surface on which the machine is resting and generally extend from the main supports (52) and (53) at a point around the front of the frame (50).

The vertical riser beams (56) and (57) are linked by a top crossbeam (58) which has attached thereto a centrally located handlebar (41) the user may grasp. The top crossbeam (58) also has attached thereto a computer control panel (72) for controlling the functions of the machine (10), particularly the location of the user's feet on the footskate (501) or platform (61), and the user's arms on the handlebar (41) or exercise arms (201), as well as other functions known to those of ordinary skill in the art.

In an embodiment, the frame (50) may include additional components, or not include any of the above components. Further, any portion of the frame (50) may be covered by a cover (13) as shown in FIG. 1 which may not provide for specific strength and support of the other components of the machine (10), but may serve to cover operating or moving parts of the machine (10) for aesthetic or safety purposes such as to keep an individual's clothing from becoming trapped in the machine (10) or simply to give the machine a particular "look."

Figure 2:
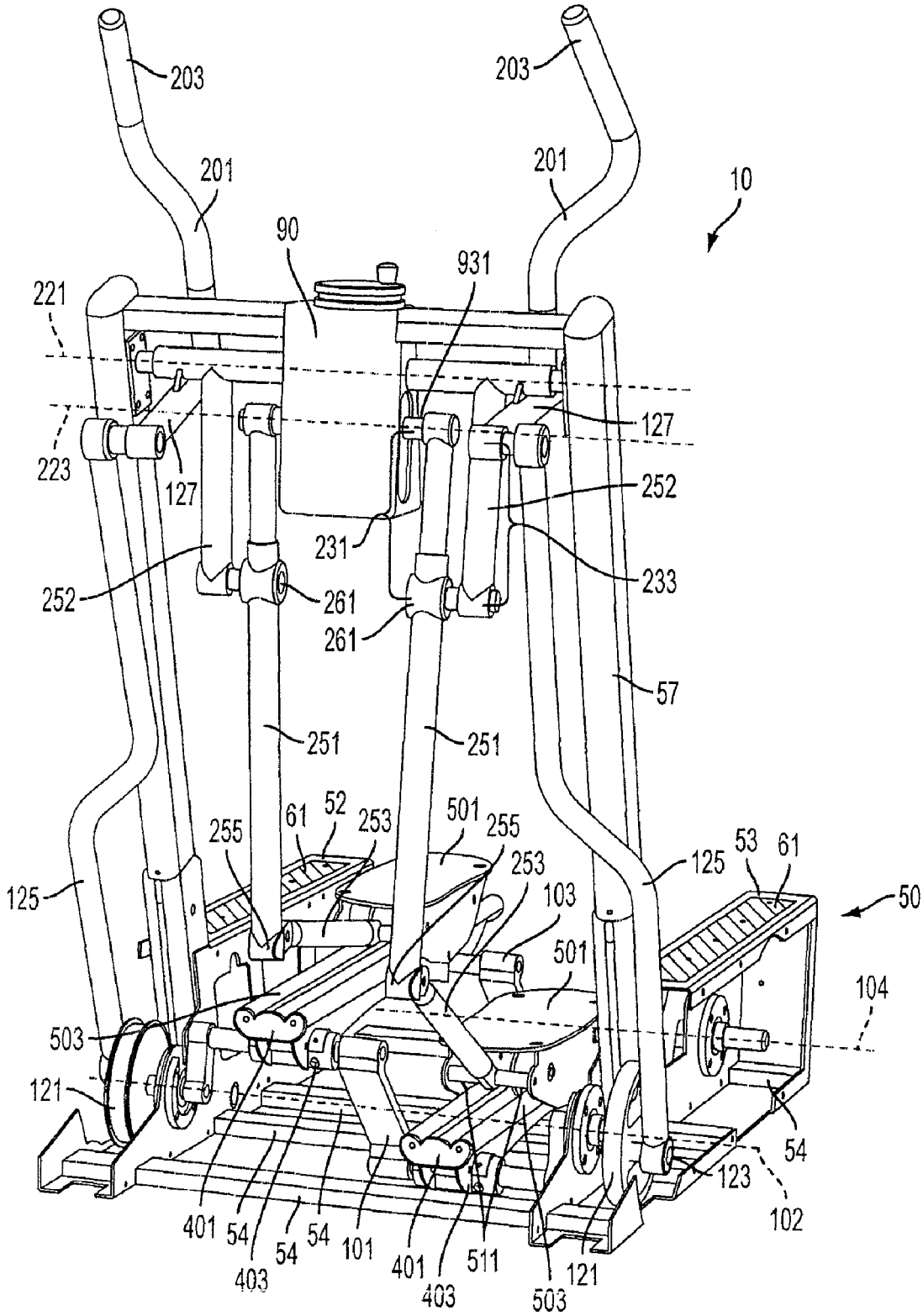
FIG. 2 shows a front angular perspective view of an embodiment with the cover removed.
Figure 3:
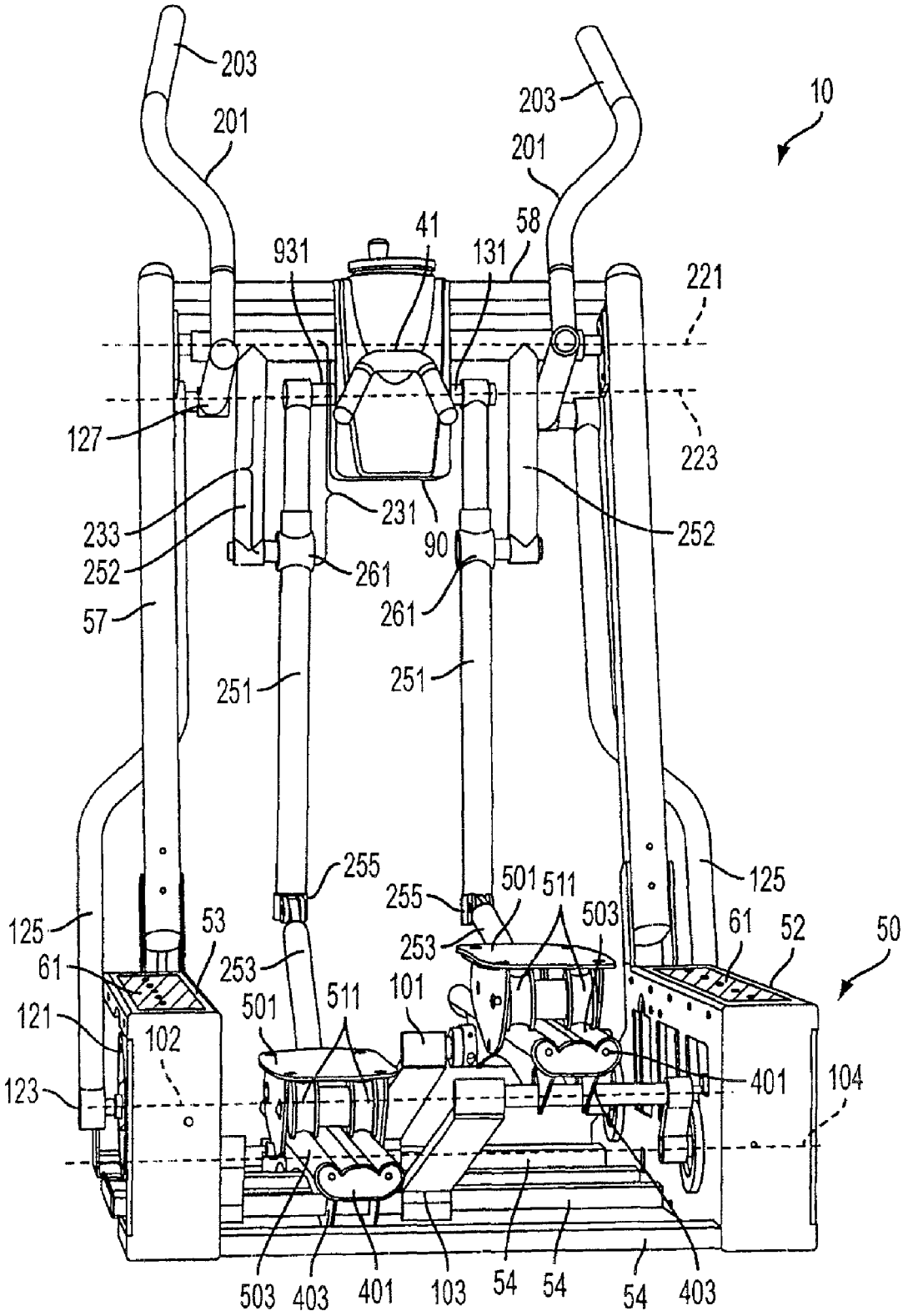
FIG. 3 shows a rear perspective view of the embodiment of FIG. 2.
Figure 4:
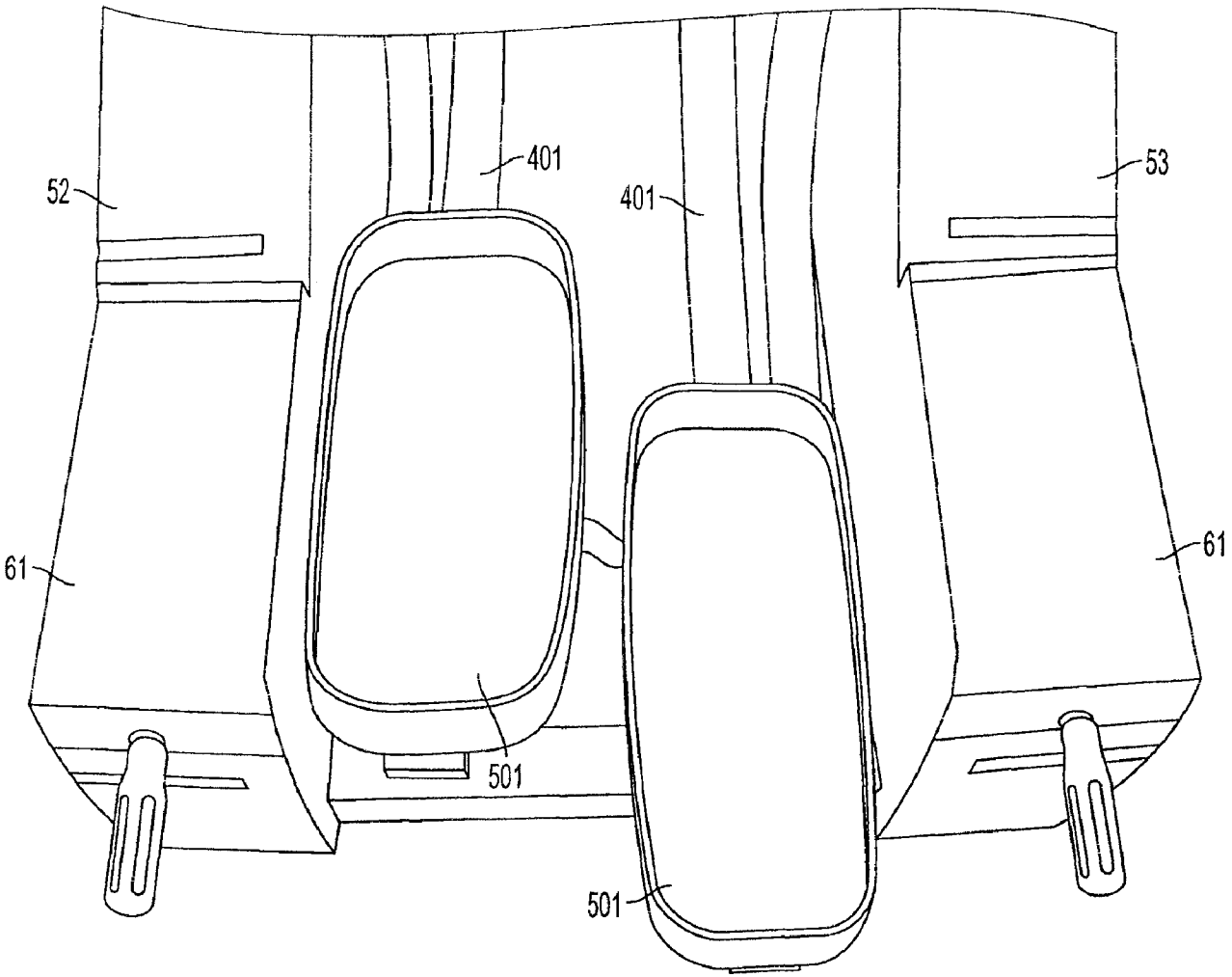
FIG. 4 shows an overhead perspective view of the embodiment of FIG. 1, focused on the platforms and footskates.

FIGS. 2 and 3 show various views of a frame (50) with the cover (not shown) removed so that internal parts are visible. Attached between the main support beams (52) and (53) is a device for transmitting rotational motion, such as a pair of crankshafts (101) and (103) or any other means known to those of ordinary skill in the art. In the depicted embodiment utilizing crankshafts, each crankshaft (101) and (103) rotates relative to the frame (50) about a central axis (102). On the front crankshaft (101), there is a wheel (121) attached at each end which will rotate in conjunction with the rotational motion of the front crankshaft (101). Each wheel (121) is attached via an offset pin (123) and drive link (125) to a rocker bar (127) such that the rocker bar (127) is caused to rock back and forth through a fixed portion of an arc.

Attached to the rocker bar (127) is an exercise arm (201). The exercise arm (201) will generally comprise two portions, the upper portion or handgrip (203) and the lower pendulum arm (252). Both portions will generally be rigidly attached both to each other and to the rocker bar (127) so as to move as a unit. The handgrip (203) at the top of the exercise arm (201) generally moves in a vertically arranged arc segment. This handgrip (203) is designed to be grasped by a user and can be used to help exercise the user's arms and to drive the motion of the crankshafts (101) and (103).

As the crankshafts (101) and (103) transcribe the circle moving the rails (401) through circles, the front crankshaft (101) will turn the wheels (121), which will, in turn, cause the pendulum arms (201) to reciprocate. By placing the user's feet directly on the rails (401), the user will be able to exercise with the machine (10) with their feet transcribing circular motion in a constantly parallel position. This circular motion may be made elliptical by providing a footskate (501) which will slide on the rail (401) at a particular rate related to the instantaneous position of the rail (401). Such sliding motion allows for alteration of the travel path from that of a circle to one approaching an ellipse. Traditionally, this elliptical motion was provided in a fixed fashion whereby the reciprocation of the rocker bars (127) was simply transferred to the footskates (501) by the distal end of the pendulum arms (252). One such arrangement of components is shown in U.S. Pat. No. 6,835,166, the entire disclosure of which is herein incorporated by reference.

There may also be included a variety of other components as is known to those of ordinary skill in the art for improving exercise motion upon which at least one of the crankshafts (101) or (103) interacts. For example, the front crankshaft (101) may drive a synchronization device, such as, but not limited to, a connecting rod. Another improvement may be a flywheel (not shown) connected to the wheel (121) or another wheel on either crankshaft (101) or (103) by means of a belt (not shown) so as to provide for more fluid and smooth motion of the rails (401).

Further, there may be one or more resistance devices (not shown) included to provide for resistance to the motion of the wheel (121) and therefore to increase the difficulty of the exercise. The resistance device may comprise a friction belt which serves to resist the rotation of the wheel (121). This design of resistance device is by no means required, however, and any type of resistance device, including but not limited to, friction devices, electromechanical devices, pneumatic or hydraulic devices, or a combination of devices may be used to provide resistance. The devices may apply to the user's entire upper and lower body experience, or may be specifically targeted at the resistance the user encounters in the upper or lower body independently.

Further, there may be a device (90) with associated structures included to permit the user to adjust the length of the stride of the exercise via the inclusion of an adjustment arm connected via a transfer arm attached toward the distal end of the adjustment arm to the front of the footskate (501). The adjustment arm (251) is rocked in a pendulum motion by the action of a coupler (261) which is located a first distance from the first axis of rotation (221) of the pendulum arm (125). The coupler (261) is also attached a second distance from the second axis of rotation (225) about which the adjustment arm (251) rotates. So as to provide for adjustment to the stride distance during the exercise, at least one of the first distance and second distance is adjustable.

While not shown, the exercise machine (10) may also include an electric drive or electric assist mechanism for users lacking the requisite strength to commence the exercise or to comfortably perform it. Such an assistance mechanism for use in conjunction with arm driven treadmills, which could be adapted for use with this elliptical machine (10), is shown in U.S. patent application Ser. No. 11/234,614, the entire disclosure of which is herein incorporated by reference.

As discussed above, so as to provide for elliptical instead of circular motion of the user's foot, each of the rails (401) has located thereon a footskate (501) which is arranged to reciprocate on a foot track (503) which is located on the rail (401). The reciprocating relationship may be accomplished by any mechanism known to those of ordinary skill in the art including sliding or rolling relationships. In the depicted embodiment, the footskate (501) includes a series of wheels (511) which roll on the foot track (503) as depicted.

Adjacent to each footskate (501) and attached to the frame (53, 54) is a stationary loadbearing platform (61), which may also take the form of a step, ledge, OT any other loadbearing area. While the depicted embodiment shows the platform (61) attached flush with the frame (53, 54), any orientation and/or point of attachment may be used. The platform (61) is of such a length and width as to accommodate both the user's foot and the space requirements of the location in which the machine is to be used. A focused view of embodiments of these platforms (61) and footskates (501) is provided in FIG. 4. They are also depicted in FIGS. 1-6.

Figure 5:
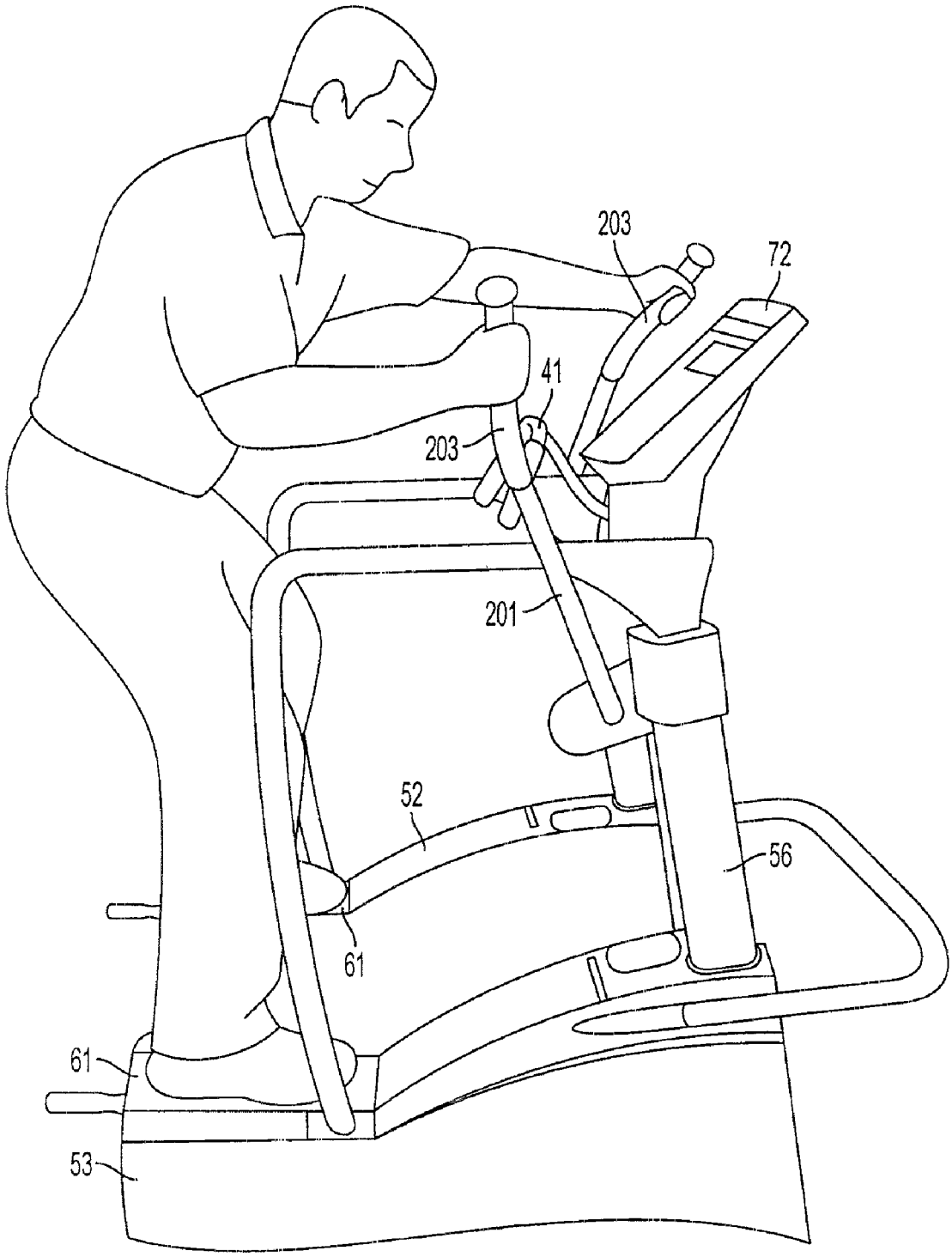
FIG. 5 shows a side perspective view of a user using the embodiment of FIG. 1.
Figure 6:
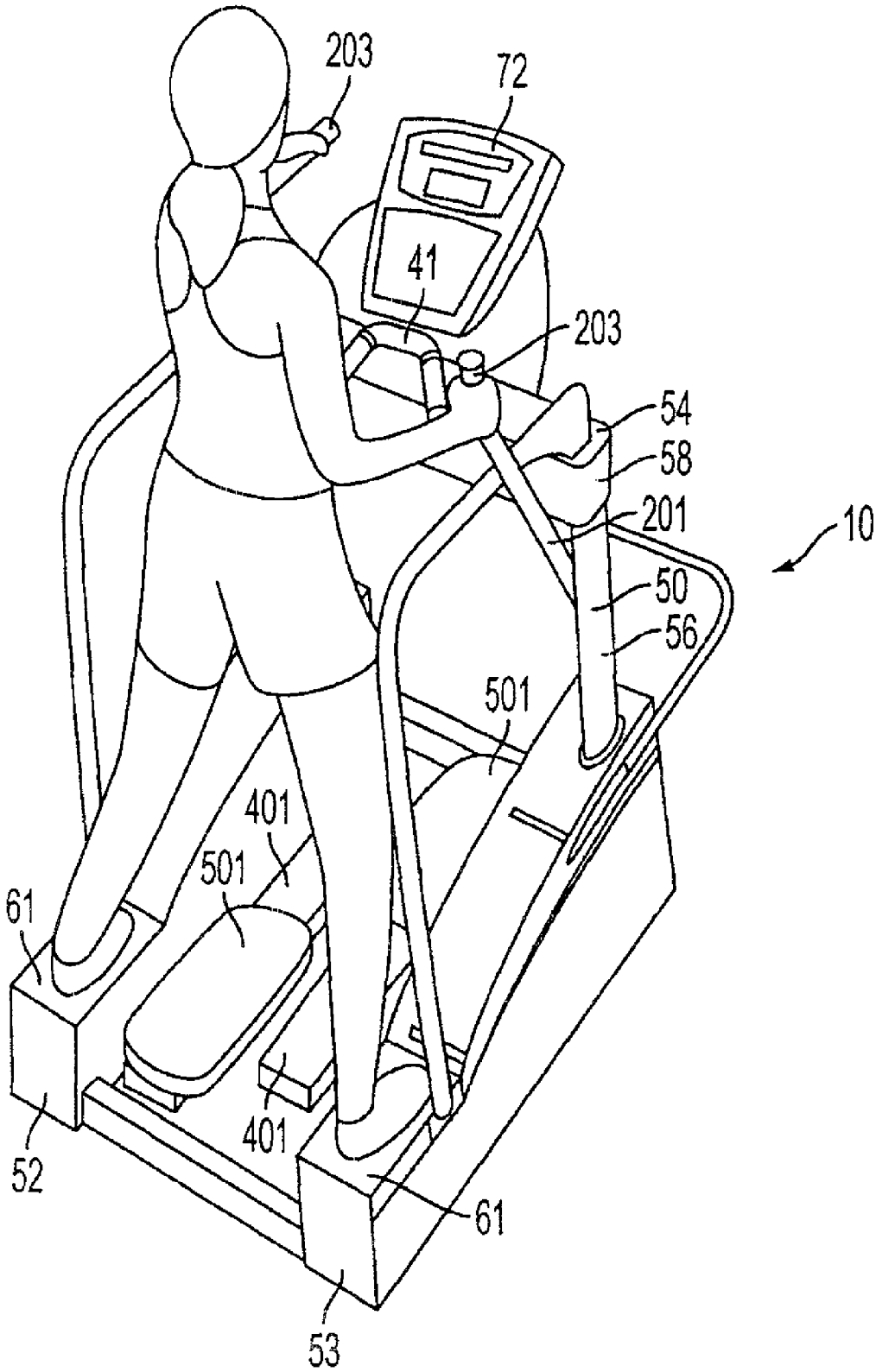
FIG. 6 shows a user on the embodiment of FIG. 1, employing the method for isolating upper and lower body workouts.

The platform's (61) spatial attributes, including vertical height, horizontal distance, and planar orientation relative to the footskate (501), are such that users may move from a position in which their feet are on the platform (61) to a different position in which their feet are on the footskate (501) during the course of the workout, which hereinafter will be called "stepping off," and back again, which hereinafter will be called "stepping on." Stepping off includes, but is not limited to, the movement of a user's foot from the footskate (501) to any embodiment of the platform (61), whether one or both platforms (61) is utilized. The platform (61) is at an operative distance and angle from the handgrip (203) and footskate (501) that permits users to continue to utilize the handgrip (203) and handlebar (41) after stepping off, and that renders the user safely clear of any continued movement of the footskate (501). Users engaging in such stepping off are depicted in FIGS. 5 and 6. Thus, by stepping off onto the platform (61), users may enjoy a stationary lower body position, and may concentrate their efforts solely on their upper bodies by moving the exercise arm (201), and selecting any available resistance and/or stance. Upon stepping off, only the user's upper body is engaged with the machine's movable parts; by moving the exercise arm (201), the user continues to cause the footskate (501) to move synchronously, but the user's lower body is no longer contributing to that movement. Any applied resistance is encountered solely by the user's upper body through the exercise arm (201). Stepping on returns the user to using his or her entire body to cause the machine's movement.

The handlebar (41) permits similar isolation of the lower body. The handlebar (41) is positioned at an operative distance and angle from the footskates (501) and exercise arm (201) that permits users grasping the handlebar (41) to continue to move their feet along the ellipse traced by the footskates (501), and that renders the user safely clear of any continued movement of the exercise arms (201). Thus, by grasping the handlebar (41), users may enjoy a stationary upper body stance and may concentrate their efforts solely on their lower bodies by moving the footskate (501) and selecting any available resistance and/or stance. Upon grasping the handlebar (41), only the user's lower body is engaged with the machine's movable parts; by moving the footskate (501), the user continues to cause the exercise arm (201) to move synchronously, but the user's upper body is no longer causing that movement. Any applied resistance is encountered solely by the user's lower body through the footskate (501).

Thus, the combination of the platform (61) with the handlebar (41) permits the user to move between three different positions: (1) standing on the footskate (501) and grasping the exercise arm (201); (2) standing on the platform (61) and grasping the exercise arm (201); and (3) standing on the footskate (501) and grasping the handlebar (41). The user may step on and off, moving among these positions or any others permitted by the disclosed hardware. Thus, the user may combine and isolate upper and lower body workouts within one machine's workout session and in different sessions. The fixed nature of the platform (61) and the handlebar (41) provides an anchor for the lower and upper body, respectively, leaving the unanchored part of the user's body solely responsible, for generating all of the machine's motion and overcoming all of its resistance. This places a greater burden on the isolated muscle group than is placed during a combined workout of the same speed and resistance, which facilitates achieving fitness goals specific to that muscle group without having to use a different machine. Isolation of the upper or lower body, and combination of those movements, may thus be achieved through the course of a workout and among workouts by moving among positions: stepping off and on, and alternating arm position between the handgrip (203) and handlebar (41).

Beyond merely permitting the combination and isolation of independent upper and lower body workouts, the platforms (61) and handlebars (41) moreover permit users to tailor these isolated workout segments as desired. For example, they may change the resistance encountered by the targeted part of their body to be more or less than the resistance encountered during the full-body workout. Users seeking to increase upper body strength, for example, may step off and increase the resistance encountered by their upper bodies to achieve a strength-related goal, which may be more than they wished to encounter with their full bodies when working towards a cardiovascular goal.

Due to the platform (61) and handlebar (41), users may also adopt a stance that targets a particular muscle group that was not possible during the more confining full-body workout. For example, users may crouch on the platform (61) while moving the exercise arm (201) to employ the shoulder and back muscles in pulling the exercise arm (201) rather than the bicep and chest muscles employed in the traditional stance. Users may also use only one platform (61) while moving the handgrip (203) to work on balance and core muscles. Other stances that work muscles that are not primarily active during traditional full-body motion include, but are not limited to, standing facing the back of the machine on the platform (61) while grasping the handgrip (203) or on the footskate (501) while grasping the handlebar (41); or standing on their toes on the footskate (501) while grasping the handlebar (41).

Finally, a workout incorporating stepping on and off or moving among positions may improve coordination and balance more than a straightforward cardiovascular workout. Users may step on and off in rapid succession or according to cues, such as musical, video, or computer-directed cues (the latter of which will be addressed below). Thus, the multiplicity of positions presented by the platform (61) and handlebar (41) affords a more complex workout than current elliptical machines.

Thus, the ability to step on and off, and to grasp either the handlebar (41) or handgrip (203), permits a single machine to provide a vastly more varied and tailored workout than current elliptical machines provide. The ability to isolate muscle groups and engage them in specific and higher-resistance exercise through stepping off and on, grasping either the handlebar (41) or handgrip (203), and assuming nontraditional stances enabled by the platform (61) and handlebar (41), frees users from the boredom and limited cardiovascular benefits of current elliptical machines. Rather than having to use a machine in addition to an elliptical machine in order to obtain fitness goals specific to a certain part of the body, users may obtain cardiovascular and specific muscle group fitness on the same machine, within the same workout.

For example, the user may start off grasping the exercise arm (203) and standing on the footskate (501), so as to engage in the maximum amount of motion to raise his or her heartrate. Then, the user may grasp the handlebar (41) and increase the resistance encountered while moving the footskate (501), so that the user may target his or her lower body musculature while still engaging in cardiovascular activity. The user may then step off onto the platform (61) and switch to grasping the handgrip (203), with decreased resistance to accommodate the machine's use by a weaker muscle group. On the platform (61), the user may crouch while moving the exercise arms (201), thus exercising a different upper body muscle group than employed during full-body movement. Finally, to cool down, the user may grasp the handgrip (203) and stand on the footskate (501) at low resistance.

In an embodiment, the platform's (61) spatial attributes are adjustable, including vertical height and/or planar orientation. The platform (61) may be adjusted for the user's comfort, fitness goals, or any other reason. In a variance on this embodiment, there are multiple steps or platforms (61) of different vertical heights, horizontal distances, and/or planar orientations relative to the footskate (501) from among which the user or directed workout can choose. In an embodiment, the handlebar's (41) spatial attributes are adjustable, including vertical height and angle relative to the frame. The handlebar (41) may be adjusted to the user's comfort, fitness goals, or any other reason. The platform (61) and/or handlebar (41) may be adjusted during the course of a workout.

Figure 7:
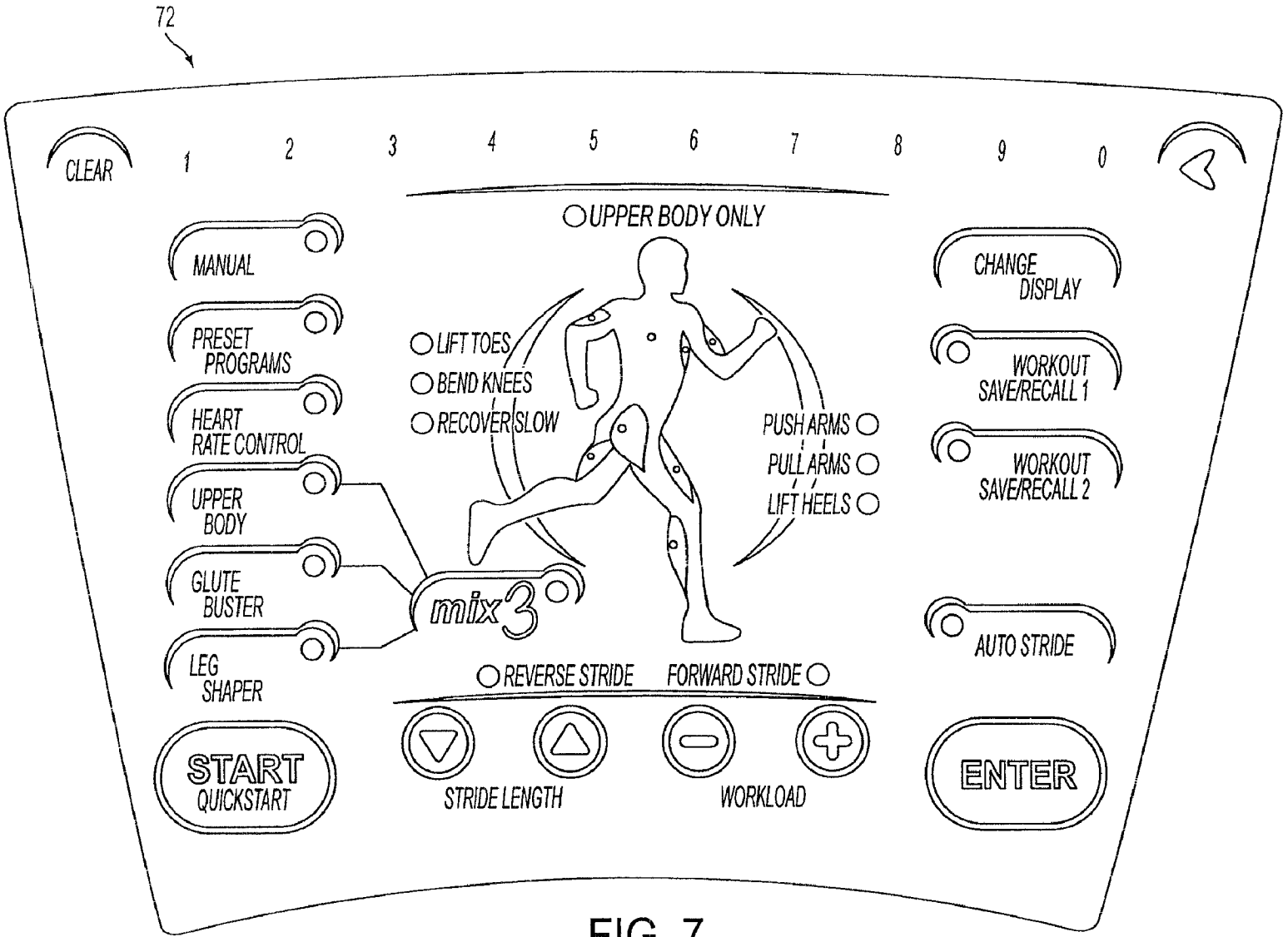
FIG. 7 shows a top partial view of an embodiment with a control panel and computer, focused on the control panel.

In an embodiment, the machine (10) will utilize the platform (61) and/or the handlebar (41) via the control panel (72) or computer which may be used to select exercise characteristics or provide exercise oversight. An embodiment of a control panel (72) is depicted in FIG. 7. Generally, the user will preselect a program of exercise which corresponds to various different types of motion to be performed in a sequence, over time. The computer will indicate or direct, through the control panel (72), at what point in time in the exercise program the user should assume different positions, i.e., step on or off the platform (61), and grasp the handlebar (41) or exercise arm (203). Thus, the computer (72) permits the user to select a directed workout that provides a combined workout, an isolated upper body workout, an isolated lower body workout, or a workout that incorporates more than one type of workouts within a single machine, by directing the user to step on and off the platform (61) and alternate between the handlebar (41) and handgrip (203). In an embodiment wherein the machine has an adjustable handlebar (41) and/or platform (61), the exercise characteristics may include the position of these components. In an embodiment with multiple platforms (61), the directed workout may direct the user to move among platforms (51) or specify a certain platform (61). The benefits of directed workouts, including their variety, set nature, and direction to specific parts of the body, are thus applied to the embodiment's capacity to provide combined and isolated upper and body workouts.

In an embodiment, the computer and/or control panel (72) may also alter the resistance the user encounters in his or her upper and lower body, in combination or in isolation. In an embodiment, the user may also use the control panel (72) and computer to alter characteristics of the directed workout, including durations of time; whether segments are to be isolated or combined, and if isolated, whether they are to be upper or lower body segments; and resistance.

In an example of the operation of the computer (72), the user would select a directed workout, including combined and isolated segments, that meets any fitness goals the user may have, such as increased upper body strength. The computer (72) may, for example, provide direction to the user to begin operating the footskate (501) and exercise arm (201) in the combined upper and lower body workout, and would set low resistance, simply to increase the user's heartrate. Once achieved, or once the programmed amount of time had passed, the computer (72) may direct the user to step off onto the platform (61) and continue operating the exercise arm (201) in an isolated upper body workout, for which the computer (72) would increase the resistance by controlling a resistance device. The computer (72) may also direct the user to assume a variety of stances over the course of the upper body workout segment in order to maintain the user's interest and target different muscle groups. After the programmed amount of time had passed, the computer (72) may direct the user to step on to the footskate (501) and continue operation of the exercise arm (201) in a combined workout at the same high level of resistance, to engage the user in a high level of activity. To bring the user's heart rate back down and rest the upper body, the computer (72) may then direct the user to grasp the handlebar (41) and continue operation of the footskate (501) in an isolated lower body workout at low resistance.

While the invention has been disclosed in connection with certain preferred embodiments, this should not be taken as a limitation to all of the provided details. Modifications and variations of the described embodiments may be made without departing from the spirit and scope of the invention, and other embodiments should be understood to be encompassed in the present disclosure as would be understood by those of ordinary skill in the art.

The invention claimed is:

1. An elliptical exercise machine comprising:

a frame;

a rail movably connected to said frame and also connected to a crankshaft such that said rail traverses a path in conjunction with said crankshaft's rotation relative to said frame;

an exercise arm connected to said frame that reciprocates as said crankshaft rotates;

a footskate capable of reciprocating movement on said rail;

a plurality of stationary loadbearing platforms, each platform adapted to support one of said user's feet, with said platforms functionally separated from said crankshaft but rigidly connected to said frame at an operative distance and angle from said exercise arm and sized and shaped to support a user while said user operates said exercise arm;

a handlebar fixedly connected to said frame at an operative distance and angle from said footskate and separated from said crankshaft; and, a control panel directing a user's use of said footskate, said platforms, said exercise arm, and said handlebar, wherein said control panel is programmed to:

instruct a user at different times to:

stand on said platforms and move said exercise arm;

stand on said footskate and move said footskate and said exercise arm simultaneously; and stand on said footskate and grasp said handlebar and move said footskate without moving said exercise arm; and alter a resistance associated with the user's use of said footskate and said exercise arm so that different resistance is provided when:

said user is standing on said platforms and moving said exercise arm, than when said user is standing on said footskate and moving said footskate and said exercise arm simultaneously, than when said user is standing on said footskate and grasping said handlebar and moving said footskate without moving said exercise arm.

2. The machine of claim 1 wherein said platforms' spatial attributes are adjustable.

3. The machine of claim 1 further comprising;

a device for adjusting the size of the stride, including:

an adjustment arm, said adjustment arm connected to said frame at a second rotational axis, spaced from said first rotational axis; said adjustment arm being operationally attached to said footskate via an interface located toward said distal end of said adjustment arm so that reciprocation of said adjustment arm through a second arc segment is translated into said reciprocating movement of said footskate; and a coupler connecting said adjustment arm to said exercise arm so that when said exercise arm reciprocates about said first rotational axis, said adjustment arm is forced to reciprocate about said second rotational axis; said coupler being spaced a first distance from said first axis and a second distance from said second axis;

wherein, at least one of said first distance and said second distance is variable, such that said stride of said machine may be altered while said machine is in use to permit stride adjustment for comfort or to generate a particular type of exercise.

4. The machine of claim 2 wherein said handlebar's spatial attributes are adjustable.

5. The machine of claim 4 wherein the control panel further instructs the user to adjust said spatial attributes of said handlebar and said platforms.

6. The machine of claim 1 wherein the control panel is programmed to further instruct a user to assume a stance on said platforms.

* * * * *